US010320077B2

(12) United States Patent
Chiou

(10) Patent No.: US 10,320,077 B2
(45) Date of Patent: Jun. 11, 2019

(54) BROADBAND ANTENNA

(71) Applicant: Sercomm Corporation, Taipei (TW)

(72) Inventor: Yi-Lin Chiou, Taipei (TW)

(73) Assignee: Sercomm Corporation, Taipei (TW)

( * ) Notice: Subject to any disclaimer, the term of this patent is extended or adjusted under 35 U.S.C. 154(b) by 0 days.

(21) Appl. No.: 15/262,018

(22) Filed: Sep. 12, 2016

(65) Prior Publication Data

US 2017/0201021 A1 Jul. 13, 2017

(30) Foreign Application Priority Data

Jan. 8, 2016 (CN) ..... 2016 2 0016433 U

(51) Int. Cl.
*H01Q 5/30* (2015.01)
*H01Q 9/04* (2006.01)
*H01Q 5/371* (2015.01)

(52) U.S. Cl.
CPC ..... *H01Q 5/30* (2015.01); *H01Q 5/371* (2015.01); *H01Q 9/0414* (2013.01); *H01Q 9/0421* (2013.01)

(58) Field of Classification Search
CPC ..... H01Q 1/24; H01Q 1/241; H01Q 1/242; H01Q 1/243; H01Q 5/30; H01Q 5/307; H01Q 5/342; H01Q 5/357; H01Q 5/364; H01Q 5/371; H01Q 9/0414; H01Q 9/0471; H01Q 9/0407
See application file for complete search history.

(56) References Cited

U.S. PATENT DOCUMENTS 6,133,879 A * 10/2000 Grangeat ..... H01Q 1/24 343/700 MS
7,728,785 B2 * 6/2010 Ozden ..... H01Q 1/243 343/866
8,344,962 B2 * 1/2013 Hui ..... H01Q 1/242 343/848
2010/0085268 A1 * 4/2010 Yeh ..... H01Q 7/00 343/803

* cited by examiner

*Primary Examiner* — Daniel Munoz
*Assistant Examiner* — Patrick R Holecek
(74) *Attorney, Agent, or Firm* — JCIPRNET

(57) ABSTRACT

A broadband antenna is provided. In the broadband antenna, the first end of a first radiation member is connected to the first end of a second radiation member to form a first commonly-connected end, and the second end of the first radiation member is connected to the second end of the second radiation member to form a second commonly-connected end, wherein the first commonly-connected end has a feed point, the second commonly-connected end is connected to a ground member, and the first radiation member is surrounded by the second radiation member and is spaced apart from the second radiation member by a gap. As a result, the broadband antenna can provide 2 frequency bands, each having ½ wavelength resonant mode in a frequency range less than 1 GHz, without the occurrence of resonant mode degradation.

18 Claims, 3 Drawing Sheets

BROADBAND ANTENNA

CROSS-REFERENCE TO RELATED APPLICATION

This application claims the priority benefit of Chinese application serial no. 201620016433.0, filed on Jan. 8, 2016. The entirety of the above-mentioned patent application is hereby incorporated by reference herein and made a part of this specification.

BACKGROUND OF THE INVENTION

Field of the Invention

The invention relates to an antenna, and more particularly, to a broadband antenna.

Description of Related Art

Since a small cell (including picocell and femtocell . . . etc.) supports a network listening (NL) technique of receiving function, different actual applications can be satisfied, and therefore small cell is a very promising solution.

In order to meet the bandwidth requirements of an NL system at 1 GHz or less, if the antenna structure having ¼ wavelength resonant mode of the prior art is used, then at low frequency, a portion of the resonant mode is degraded, and as a result the frequency band requirements of an NL system cannot be met.

SUMMARY OF THE INVENTION

The invention provides a broadband antenna capable of providing different resonant modes at low frequency band without the occurrence of resonant mode degradation.

The broadband antenna of the invention includes: a ground member; a first radiation member for providing a first resonant path to make the broadband antenna cover a first frequency band; and a second radiation member for providing a second resonance path to make the broadband antenna cover a second frequency band, wherein the first end of the second radiation member is connected to the first end of the first radiation member to form a first commonly-connected end, the first commonly-connected end has a feed point, the second end of the first radiation member is connected to the second end of the second radiation member to form a second commonly-connected end, and the second commonly-connected end is connected to the ground member, wherein the first radiation member is surrounded by the second radiation member and is spaced apart from the second radiation member by a gap.

The broadband antenna can provide 2 frequency bands, each of which has ½ wavelength resonant mode, in a frequency range less than 1 GHz without the occurrence of resonant mode degradation, and therefore the broadband antenna is suitable for application in network listening (NL) techniques.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
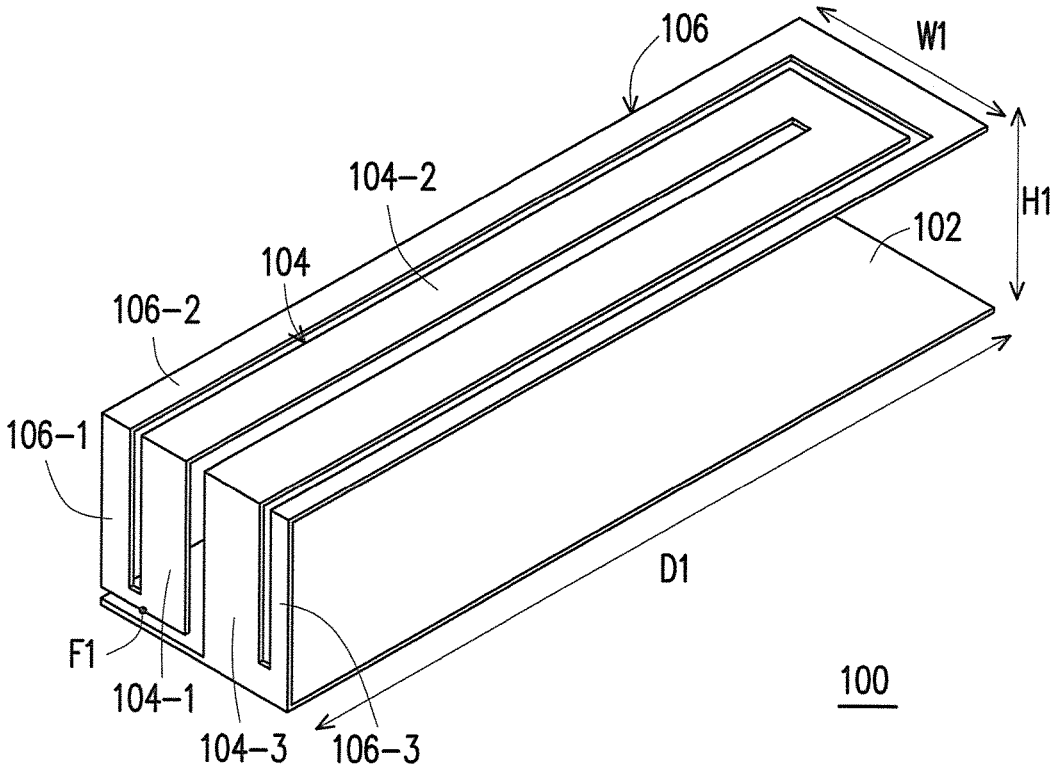
FIG. 1 is a schematic of a broadband antenna of an embodiment of the invention.

FIG. 1 is a schematic of a broadband antenna of an embodiment of the invention. Please refer to FIG. 1. A broadband antenna 100 includes a ground member 102, a first radiation member 104, and a second radiation member 106, wherein the first end of the first radiation member 104 is connected to the first end of the second radiation member 106 to form a first commonly-connected end, and the first commonly-connected end has a feed point F1. Moreover, the second end of the first radiation member 104 is connected to the second end of the second radiation member 106 to form a second commonly-connected end, and the second commonly-connected end is connected to the ground member 102. Moreover, the first radiation member 104 is surrounded by the second radiation member 106, and the first radiation member 104 and the second radiation member 106 are spaced apart by a gap.

More specifically, the first radiation member 104 can include a first connecting segment 104-1, a second connecting segment 104-2, and a third connecting segment 104-3, and the second radiation member 106 can include a fourth connecting segment 106-1, a fifth connecting segment 106-2, and a sixth connecting segment 106-3. In particular, the first end of the first connecting segment 104-1 is connected to the first end of the fourth connecting segment 106-1 (i.e., the first end of the second radiation member 106) to form the first commonly-connected end, the first end and the second end of the second connecting segment 104-2 are respectively connected to the second end of the first connecting segment 104-1 and the first end of the third connecting segment 104-3, and the second end of the third connecting segment 104-3 is connected to the second end of the sixth connecting segment 106-3 (i.e., the second end of the second radiation member 106) to form the second commonly-connected end. Moreover, the first end and the second end of the fifth connecting segment 106-2 are respectively connected to the second end of the fourth connecting segment 106-1 and the first end of the sixth connecting segment 106-3. In the present embodiment, the second connecting segment 104-2 and the fifth connecting segment 106-2 are located on a first plane, and the first connecting segment 104-1, the third connecting segment 104-3, the fourth connecting segment 106-1, and the sixth connecting segment 106-3 are located on a second plane. In particular, the first plane can be parallel to the ground member 102, an angle can be between the first plane and the second plane, and as shown in FIG. 1, the angle can be, for instance, 90 degrees, but is not limited thereto.

A feed point F1 on the first commonly-connected end can receive a feed signal, and under the excitation of the feed signal, currents in the same direction can be respectively formed on the first radiation member 104 and the second radiation member 106. In particular, the first resonance path provided by the first radiation member 104 can generate a resonant mode, such that the broadband antenna 100 covers a first frequency band, and the second resonance path provided by the second radiation member 106 can generate another resonant mode, such that the broadband antenna 100 covers a second frequency band. In the present embodiment, the length of the first resonance path is less than the length of the second resonance path (as shown in FIG. 1), and therefore the center frequency of the first frequency band is higher than the center frequency of the second frequency band. In particular, the first frequency band can be between 869 MHz and 894 MHz, and the second frequency band can be between 729 MHz and 756 MHz. That is, the antenna structure of the present embodiment can provide 2 similar center frequencies in a frequency range less than 1 GHz, and each of the band has a frequency band of ½ wavelength resonant mode without the occurrence of resonant mode degradation. As a result, the frequency band requirements of network listening (NL) techniques in low frequency range can be met. Moreover, in the structure of the broadband antenna 100 of the present embodiment, a height H1 of the broadband antenna can be as low as 18 mm, and a length D1 and a width W1 thereof can respectively only be 70 mm and 20 mm. That is, the broadband antenna 100 has the advantage of small size and can be readily applied in various communication devices.

It should be mentioned that, in the embodiment of FIG. 1, although the first radiation member 104 and the second radiation member 106 include a bent section (such as a portion interconnecting the first connecting segment 104-1 and the second connecting segment 104-2), in some embodiments, the first radiation member 104 and the second radiation member 106 can also not include a bent section. That is, the first radiation member 104 and the second radiation member 106 can also be implemented as planar antennas. Moreover, in the embodiment of FIG. 1, the first radiation member 104 and the second radiation member 106 are conformal. For instance, in the embodiment of FIG. 1, the second connecting segment 104-2 and the fifth connecting segment 106-2 are both U-shaped connecting segments, but are not limited thereto in actual application. In some embodiments, the second connecting segment 104-2 and the fifth connecting segment 106-2 can also be other shapes, such as an oval having a notch. Alternatively, in other embodiments, the first radiation member 104 and the second radiation member 106 can also be different shapes.

Figure 2:
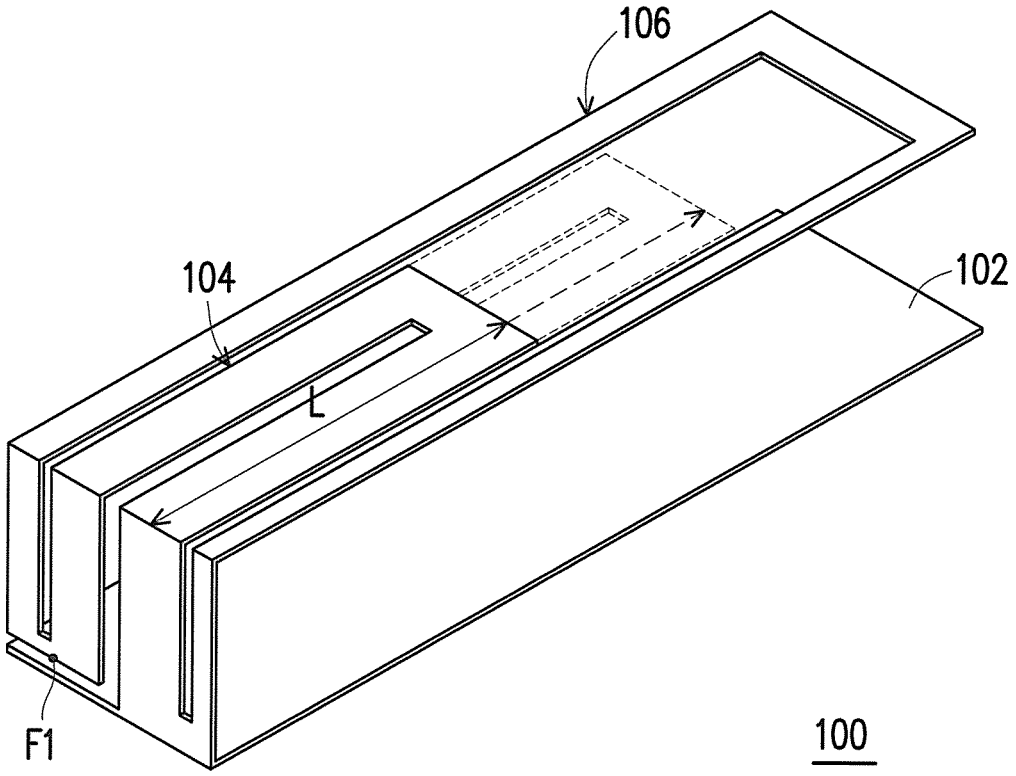
FIG. 2 is a schematic of a broadband antenna of another embodiment of the invention.
Figure 3:
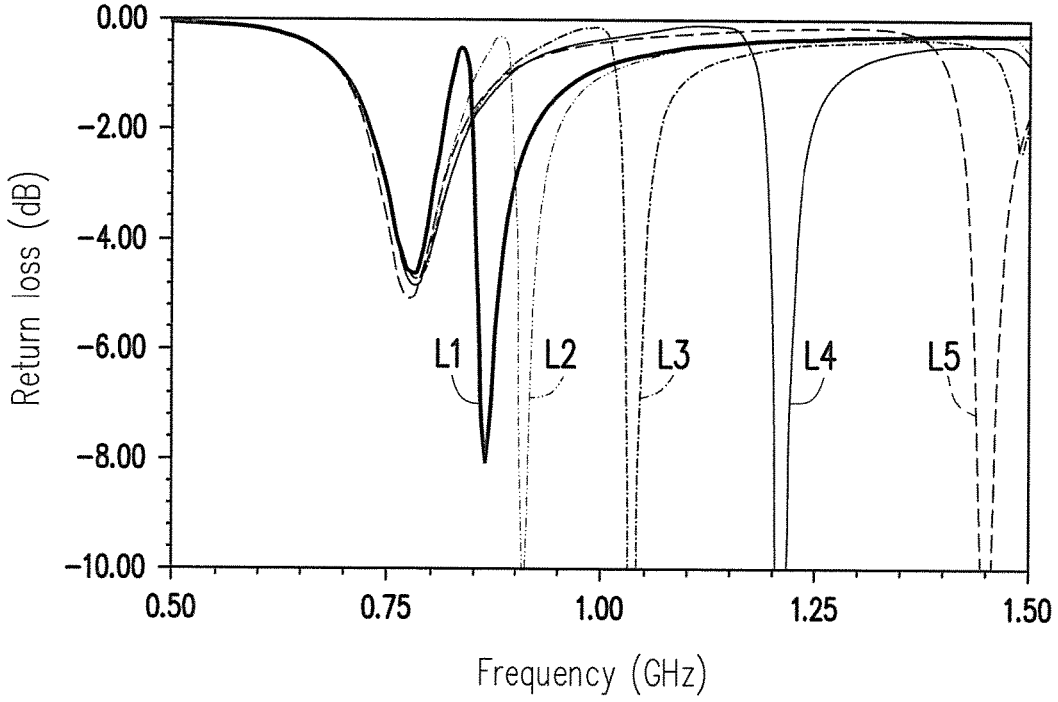
FIG. 3 is a schematic of a return loss test of a broadband antenna of an embodiment of the invention.

Moreover, the center frequencies of the first frequency band and the second frequency band can be adjusted by changing the lengths of the first radiation member 104 and the second radiation member 106. For instance, FIG. 2 is a schematic of a broadband antenna of another embodiment of the invention. Please refer to FIG. 2. In the embodiment of FIG. 2, by changing the length of the first radiation member 104, i.e., changing the length of the resonance path provided by the first radiation member 104, the center frequency of the first frequency band can be adjusted. As shown in the return loss test schematic of a broadband antenna of FIG. 3, when the length of the first radiation member 104 is increased, the length L shown in FIG. 2 is also increased, and curve L1, curve L2, curve L3, curve L4, and curve L5 in FIG. 3 respectively represent the curves corresponding to the length L of FIG. 2 at 69 mm, 65 mm, 55 mm, 45 mm, and 35 mm. It can be known from FIG. 3 that, when the length L is increased, i.e., the length of the first radiation member 104 is increased, the center frequency corresponding to the first radiation member 104 is also reduced. As shown in FIG. 3, when the length L is 69 mm, 65 mm, 55 mm, 45 mm, and 35 mm, the center frequencies corresponding thereto are respectively about 0.85 GHz, 0.91 GHz, 1.04 GHz, 1.21 GHz, and 1.45 GHz. Even when the center frequency of the first frequency band is reduced to 0.85 GHz and close to the center frequency of the second frequency band (about 0.77 GHz), it can still be clearly seen from FIG. 3 that the resonant modes generated by the first radiation member 104 and the second radiation member 106 are both still significant. It can therefore be known that, the broadband antenna 100 of the embodiments can indeed solve the issue of degradation to resonant mode of the current antenna at low frequency, and can satisfy the frequency band requirements of an NL system. Similarly, the center frequency of the second frequency band can also be adjusted by changing the length of the second radiation member 106, and the adjustment method thereof is similar to the adjustment method of the first frequency band, and is therefore not repeated herein.

The broadband antenna of the above embodiments can provide 2 frequency bands, each having ½ wavelength resonant mode in a frequency range less than 1 GHz, and even if the center frequencies of two low frequency bands are close, resonant mode degradation still does not occur.

What is claimed is:

1. A broadband antenna, comprising:

a ground member;

a first radiation member for providing a first resonance path to make the broadband antenna cover a first frequency band; and a second radiation member for providing a second resonance path to make the broadband antenna cover a second frequency band, wherein a first end of the second radiation member is directly connected to a first end of the first radiation member to form a first commonly-connected end, the first commonly-connected end has a feed point directly connected to the first end of the first radiation member and the first end of the second radiation member, a second end of the first radiation member is connected to a second end of the second radiation member to form a second commonly-connected end, and the second commonly-connected end is connected to the ground member, wherein the first radiation member is surrounded by the second radiation member and is spaced apart from the second radiation member by a gap, wherein the gap is located solely on a first plane and a second plane perpendicular to the first plane.

2. The broadband antenna of claim 1, wherein a length of the first resonance path is less than a length of the second resonance path.

3. The broadband antenna of claim 1, wherein the first frequency band is between 869 MHz and 894 MHz.

4. The broadband antenna of claim 1, wherein the second frequency band is between 729 MHz and 756 MHz.

5. The broadband antenna of claim 1, wherein the first radiation member and the second radiation member are conformal.

6. The broadband antenna of claim 1, wherein the first radiation member comprises:

a first connecting segment, wherein a first end thereof is connected to the first end of the second radiation member to form the first commonly-connected end;

a second connecting segment, wherein a first end thereof is connected to a second end of the first connecting segment; and a third connecting segment, wherein a first end thereof is connected to a third end of the second connecting segment, and a second end of the third connecting segment is connected to the second end of the second radiation member to form the second commonly-connected end.

7. The broadband antenna of claim 1, wherein a first part of the first radiation member and a first part of the second radiation member are located on a first plane, and a rest part of the first radiation member and a rest part of the second radiation member are located on a second plane.

8. The broadband antenna of claim 1, wherein a first part of the first radiation member is and a first part of the second radiation member are located on a first plane to directly connected to the feed point located on the first plane, and a rest part of the first radiation member has three sides located on a second plane to be surrounded by a rest part of the second radiation member on the second plane.

9. A broadband antenna, comprising:

a ground member;

a first radiation member for providing a first resonance path to make the broadband antenna cover a first frequency band; and a second radiation member for providing a second resonance path to make the broadband antenna cover a second frequency band, wherein a first end of the second radiation member is directly connected to a first end of the first radiation member to form a first commonly-connected end, the first commonly-connected end has a feed point directly connected to the first end of the first radiation member and the first end of the second radiation member, a second end of the first radiation member is connected to a second end of the second radiation member to form a second commonly-connected end, and the second commonly-connected end is connected to the ground member, wherein a length of the first resonance path is less than a length of the second resonance path, and the first radiation member is surrounded by the second radiation member, wherein a gap enclosed by the first radiation member and the second radiation member is located solely on a first plane and a second plane perpendicular to the first plane.

10. The broadband antenna of claim 9, wherein the first frequency band is between 869 MHz and 894 MHz.

11. The broadband antenna of claim 9, wherein the second frequency band is between 729 MHz and 756 MHz.

12. The broadband antenna of claim 9, wherein the first radiation member and the second radiation member are conformal.

13. The broadband antenna of claim 9, wherein the first radiation member comprises:

a first connecting segment, wherein a first end thereof is connected to the first end of the second radiation member to form the first commonly-connected end;

a second connecting segment, wherein a first end thereof is connected to a second end of the first connecting segment; and a third connecting segment, wherein a first end thereof is connected to a third end of the second connecting segment, and a second end of the third connecting segment is connected to the second end of the second radiation member to form the second commonly-connected end.

14. The broadband antenna of claim 13, wherein the second radiation member comprises:

a fourth connecting segment, wherein a first end thereof is connected to the first end of the first connecting segment;

a fifth connecting segment, wherein a first end thereof is connected to a second end of the fourth connecting segment; and a sixth connecting segment, wherein a first end thereof is connected to a second end of the fifth connecting segment, a second end of the sixth connecting segment is connected to the second end of the third connecting segment, the second connecting segment and the fifth connecting segment are located on a first plane, the first connecting segment, the third connecting segment, the fourth connecting segment, and the sixth connecting segment are located on a second plane, and an angle is between the first plane and the second plane.

15. The broadband antenna of claim 14, wherein the second connecting segment and the fifth connecting segment are U-shaped connecting segments.

16. The broadband antenna of claim 14, wherein the ground member is parallel to the first plane.

17. The broadband antenna of claim 9, wherein a first part of the first radiation member and a first part of the second radiation member are located on a first plane, and a rest part of the first radiation member and a rest part of the second radiation member are located on a second plane.

18. The broadband antenna of claim 9, wherein a first part of the first radiation member and a first part of the second radiation member are located on a first plane to directly connected to the feed point located on the first plane, and a rest part of the first radiation member has three sides located on a second plane to be surrounded by a rest part of the second radiation member on the second plane.

* * * * *